US008083649B1

(12) United States Patent
Cordova

(10) Patent No.: US 8,083,649 B1
(45) Date of Patent: Dec. 27, 2011

(54) WRIST EXERCISE DEVISE

(76) Inventor: Anthony C. Cordova, Anchorage, AK (US)

( * ) Notice: Subject to any disclaimer, the term of this patent is extended or adjusted under 35 U.S.C. 154(b) by 238 days.

(21) Appl. No.: 12/214,675

(22) Filed: Jun. 19, 2008

(51) Int. Cl.
*A63B 21/00* (2006.01)

(52) U.S. Cl. ..... 482/49; 482/45; 482/46; 482/50

(58) Field of Classification Search ..... 482/117, 482/118, 44–49, 119, 120
See application file for complete search history.

(56) References Cited

U.S. PATENT DOCUMENTS 212,946 A * 3/1879 Johnson ..... 482/117
1,535,391 A * 4/1925 Anderson ..... 482/117
1,911,572 A * 5/1933 Hulander et al. ..... 482/142
2,126,443 A * 8/1938 Begley ..... 482/117
3,428,311 A * 2/1969 Mitchell ..... 482/45
3,749,399 A * 7/1973 Fedor et al. ..... 472/25
5,358,463 A * 10/1994 Fuentes ..... 482/141

* cited by examiner

*Primary Examiner* — Jerome W Donnelly
(74) *Attorney, Agent, or Firm* — Michael J. Tavella

(57) ABSTRACT

A wrist exerciser that uses nested semi spheres to work the wrists. It has an outer bowl-shaped housing that can be mounted to a wall, or can he held by the user using a special glove. A second bowl-shaped device called the pendulum has a handle in the center and fits within the housing. A third member called a pressure bowl is fitted into the outer housing. The pressure bowl has an open bottom to let pendulum handle pass through the bottom of the pressure bowl. The user tightens the pressure bowl down to increase the tightness of the pendulum within the outer housing. A user can mount the device on a wall or grip the bottom of the outer bowl. Then, the user holds the handle on the pendulum and rotates the pendulum around the outer housing, back and forth in any desired direction to work the wrist.

16 Claims, 13 Drawing Sheets

WRIST EXERCISE DEVISE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to wrist exercise devices and particularly to semispherical wrist exercise devices.

2. Description of the Prior Art

Many fields of work and sports require strong wrists. To build up a user's wrist strength, many devices have been developed. Most of these devices use either bands or some type of ball that works the user's wrists to develop stronger wrist muscles.

Although these devices work, they are not always efficient or convenient to use. Some, for example, require the user to roll the ball over a floor surface. If not enough room is available, the exercise is not going to work.

BRIEF DESCRIPTION OF THE INVENTION

The instant invention overcomes these difficulties. It is a wrist exerciser that uses nested semi spheres to work the wrists. The invention has an outer bowl-shaped housing that can be mounted to a wall, or held by the user using a special glove. The housing has a ring of ball bearings in it to receive a second bowl-shaped device called the pendulum, which is what the user actually works in the exercises. This "pendulum" has a handle in the center and fits within the housing. The outer walls of the pendulum rest against the ball bearings of the outer housing. Finally, a third bowl-shaped member called a pressure bowl is fitted into the outer housing. The pressure bowl has an open bottom so that the handle of the pendulum can pass through the bottom of the pressure bowl. The pressure bowl has a ring of ball bearings around its outer wall that rests against the inner walls of the pendulum. The top of the pressure bowl is threaded to mate with threads on the outer housing. The user can tighten the pressure bowl down to increase the tightness of the pendulum within the outer housing.

With all three components in place, and the pressure bowl set at the least resistance level, a user can either mount the device on a wall to hold it, or grip the bottom of the outer bowl. Then, the user holds the handle on the pendulum and uses it to rotate the pendulum around the outer housing, back and forth in any desired direction to work the wrist. As the pressure bowl is tightened down, the movement of the pendulum becomes more difficult, providing greater exercise of the wrist. When one wrist is done, the user simply switches hands and continues to work out.

The unit provides adjustable resistance for all natural motions of the wrist. The unit also works the forearm muscles. The nature of the exercise provided by the unit ensures that the user maintains flexibility within the muscles while building strength.

The device thus provides an efficient way to exercise the hands, wrists and forearms to benefit seasonal workers, athletes, factory workers, children, and workers in the fishing industry as well as assisting in physical therapy and injury recovery.

DETAILED DESCRIPTION OF THE INVENTION

Figure 1:
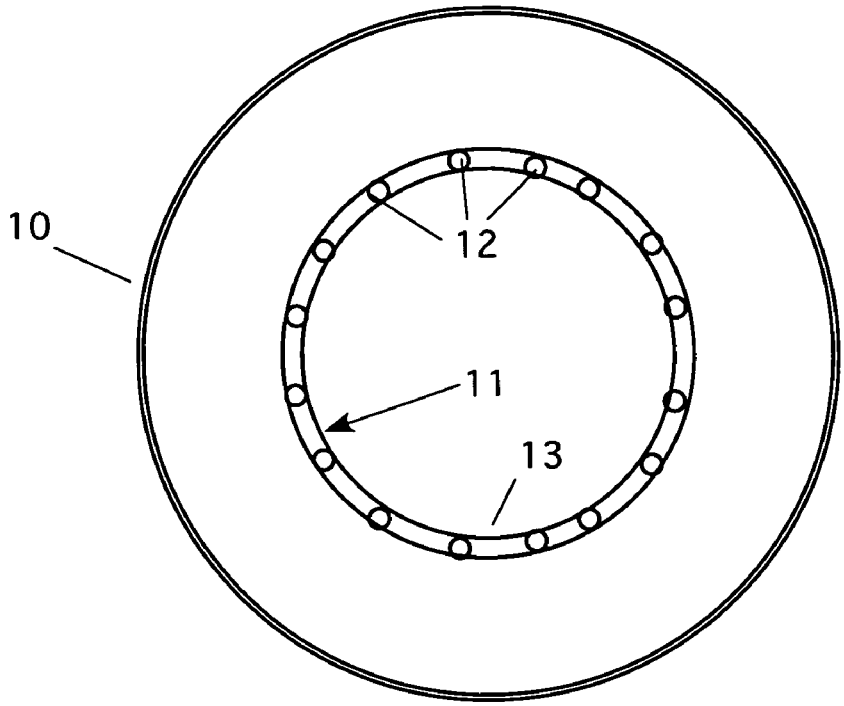
FIG. 1 is a top view of the outer housing.

Referring now to FIG. 1, top view of the outer housing. The outer housing 10 is a semi-spherical bowl that has a hollow interior. A ring bearing 11 is positioned within the outer housing as shown. The bearing 11 has a number of ball bearings 12 that are set in a race 13 that is curved to fit the shape of the bowl. Note also that the ring bearing is tapered to fit the shape of the bowl.

Figure 2:
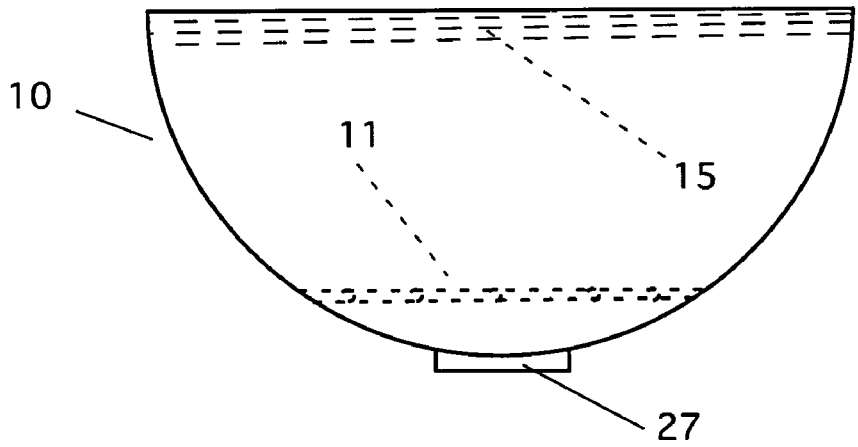
FIG. 2 is a side view of the outer housing.

FIG. 2 is a side view of the outer housing. Here, the clip 27 is shown at the bottom of the outer housing 10. The clip 27 is used as part of a gripping mechanism, which is discussed in greater detail below. Note also that the outer housing has a set of threads 15 formed at the top of the outer housing as shown.

Figure 3:
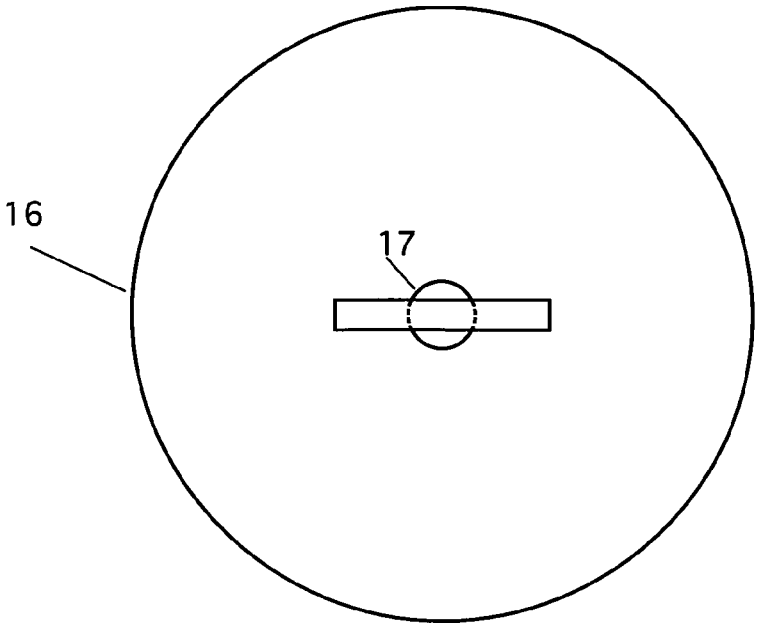
FIG. 3 is a top view of the pendulum.

FIG. 3 is a top view of the pendulum 16. The pendulum 16 is another bowl-shaped member with a hollow interior. It has a handle 17 that extends upwards from the base of the bowl as shown. The pendulum is placed into the outer housing (see FIG. 12) so that the outer surface of the pendulum rides on the ring bearing 11. This allows the pendulum to rotate and slide freely within the outer housing.

Figure 4:
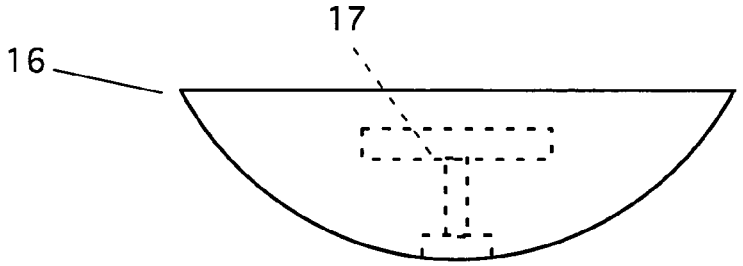
FIG. 4 is a side view of the pendulum.

FIG. 4 is a side view of the pendulum. In this figure, the handle 17 is shown. Note that in the preferred embodiment, the handle is shaped like a "T". This provides the best form for developing the user's wrist.

Figure 5:
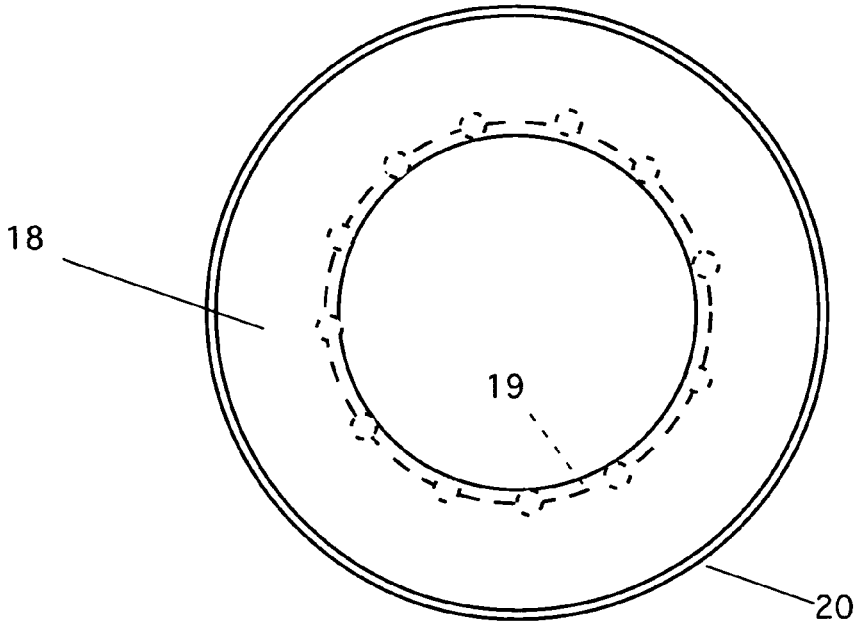
FIG. 5 is a top view of the pressure bowl.

FIG. 5 is a top view of the pressure bowl 18. As noted, when the pendulum 16 is placed within the outer housing 10, it moves freely on the ball bearings. To provide increased resistance for muscle development the pressure bowl 18 is used. This is a bowl-shaped member that has a ring of ball bearings 19 set about the bottom of the outside of the bowl structure as shown. Note also that the ring bearing here is also tapered to fit the shape of the pressure bowl. The pressure bowl has an open bottom so that the handle can fit through it (see FIG. 12).

Figure 6:
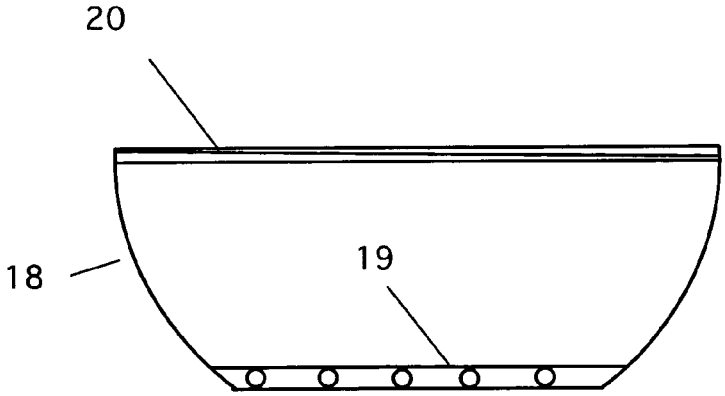
FIG. 6 is a side view of the pressure bowl.

FIG. 6 is a side view of the pressure bowl. The pressure bowl has a plurality of threads 20 formed on the outer surface of the bowl. These threads engage the threads on the outer housing (see FIG. 12). The pressure bowl is positioned within the pendulum so that the bearings ride against the inner surface of the pendulum. As the pressure bowl is screwed down into the outer housing, the pressure on the pendulum is increased, making it more difficult to move the pendulum within the outer housing. In this way, the user can get more or less resistance to better develop the user's wrist.

Figure 7:
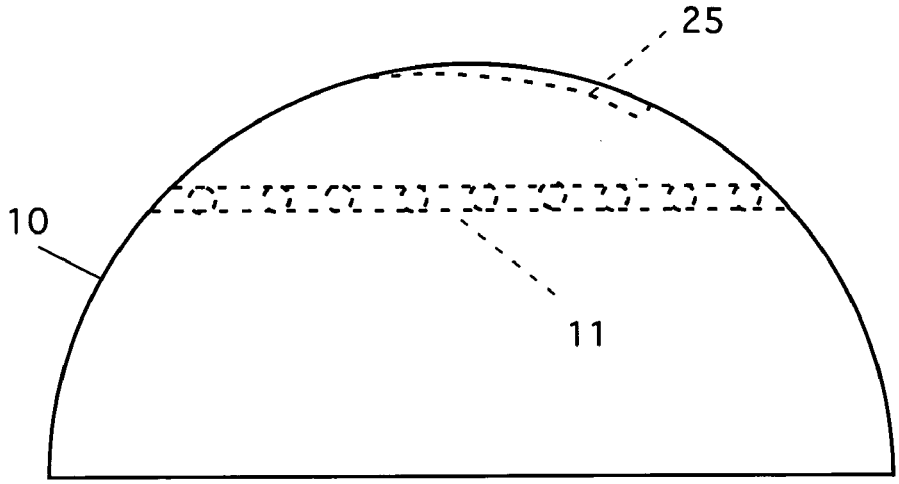
FIG. 7 is a side detail of the outer housing showing a recessed track for gripping accessories.
Figure 8:
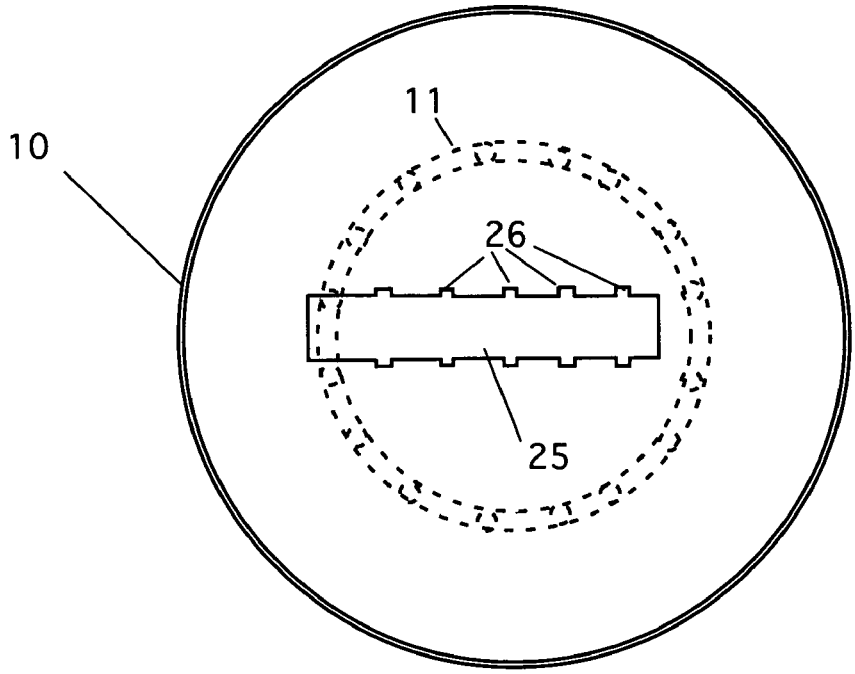
FIG. 8 is a bottom view of the outer housing showing the recessed track with a series of notched steps.

As discussed above, the device can be used with a glove grip. The device can also be attached to a wall for a more permanent setup, such as in a gym. In either case, the outer housing is adapted to receive a fixture that enables either the wall mount or the glove to be used. FIG. 7 is a side detail of the outer housing 10 showing a recessed track 25 for gripping accessories. The track 25 is used to hold either a wall mount bracket or glove, as discussed below. FIG. 8 is a bottom view of the outer housing showing the recessed track 25 with a series of notched steps 26. The track accepts a clip 27 that slides in the track and clips into the notched steps, as discussed below. The sliding dip and notched steps allow the angle of the outer housing, and thus, the pendulum handle to be adjusted for comfort, as desired.

Figure 9:
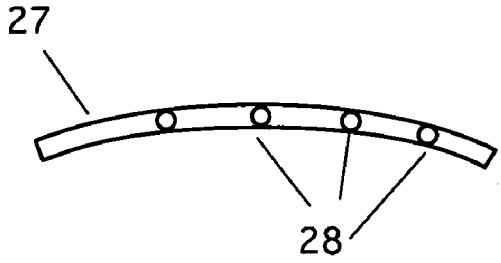
FIG. 9 is a side view of a dip used for the gripping accessories.

FIG. 9 is a side view of a dip 27 used for the gripping accessories. The clip is generally curved to match the shape of the outer housing. Knobs 28 extend outwards from the sides of the clip. The knobs 28 engage the notched steps to secure the clip 27 in a particular position.

Figure 10:
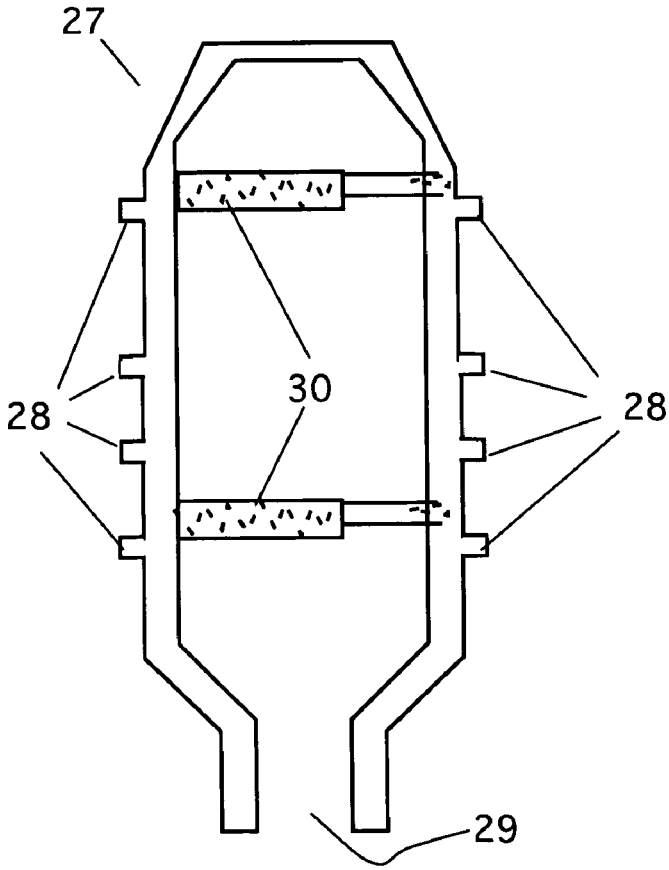
FIG. 10 is a top view of the clip of FIG. 9.

FIG. 10 is a top view of the clip 27 of FIG. 9. The clip 27 has a generally rectangular shape as shown with an open bottom 29. Two spring-loaded tubes 30 are provided. These allow the clip to be compressed to permit the clip to be moved within the track. The knobs 28 are shown on the outer perimeter of the clip. In use, the user compresses the spring tubes by squeezing the two ends of the clip at the bottom. Then, the user places the clip into the desired position. When the desired position is reached, the user simply releases the ends of the clip so that the knobs 28 fit into the notched steps 26 of the track. At that point, the clip is secured in place.

Figure 11:
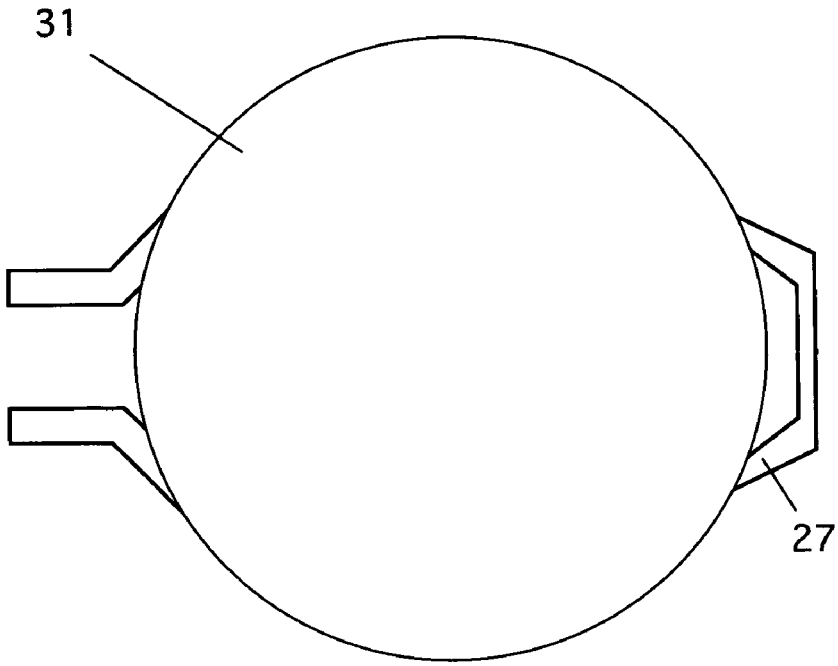
FIG. 11 is a detail view of the dip showing a plastic disk secured to the clip.

FIG. 11 is a detail view of the clip showing a plastic disk 31 secured to the clip. In this figure, the disk 31 is secured to the dip using epoxy or other fasteners common to the art.

Figure 11A:
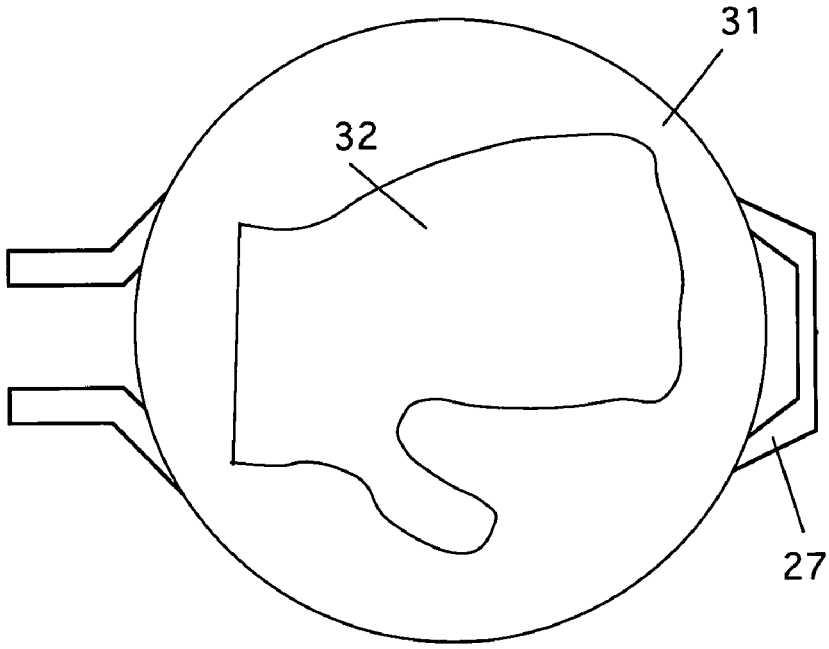
FIG. 11*a* is a detail view of the dip with a glove secured to the plastic disk.

FIG. 11*a* is a detail of the clip with a glove 32 secured to the plastic disk. Here, a glove 32 is secured to the disk 31 using a non-permanent fastening means such as a hoop and loop type fastener. Note that the glove is designed to be worn by either hand and is designed simply to support the outer housing during use.

Figure 11B:
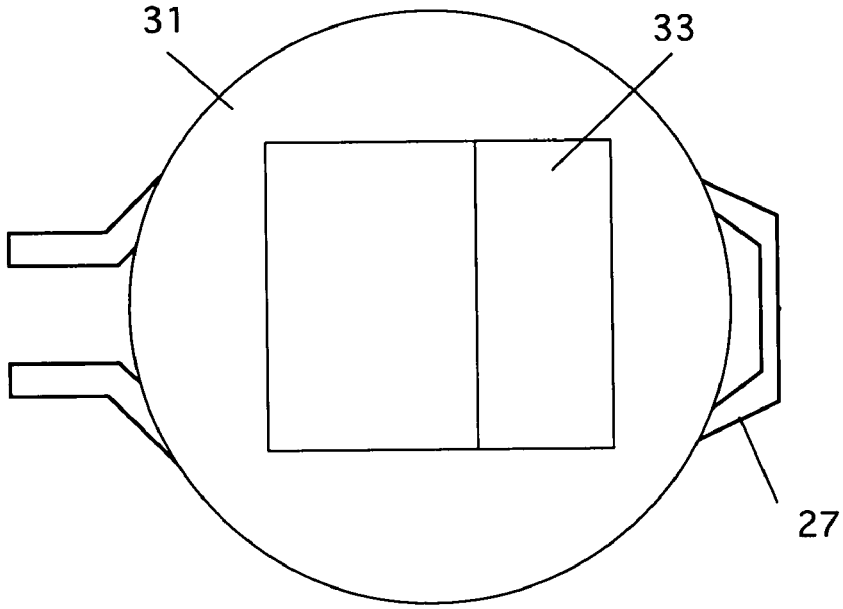
FIG. 11*b* is a detail view of the clip with a mounting bracket secured to the plastic disk.

FIG. 11*b* is a detail of the clip 27 with a mounting bracket 33 secured to the plastic disk. The mounting bracket is part of a two-part system. The bracket is secured to the clip 27, which is secured to the outer housing 10.

Figure 11C:
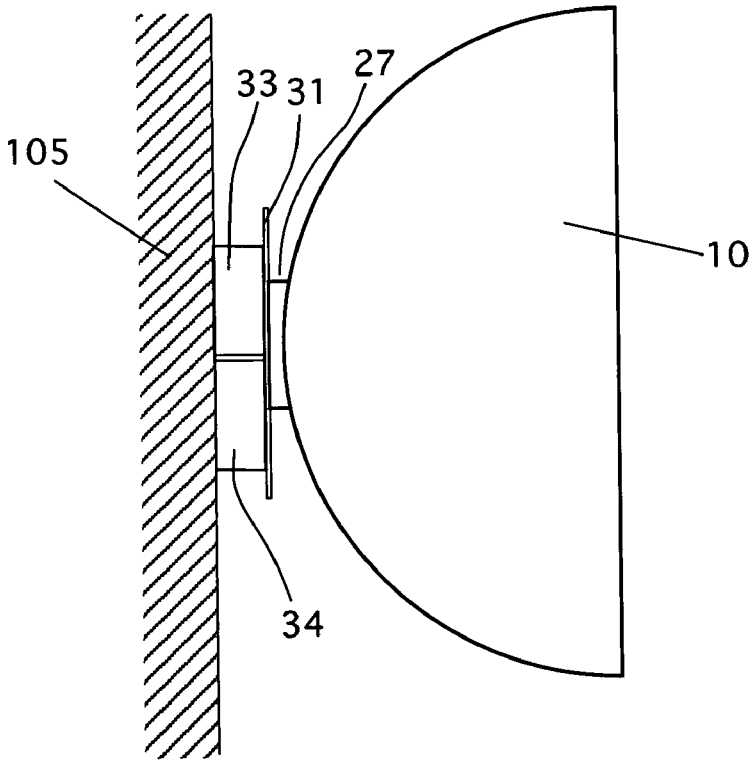
FIG. 11*c* is a detail view of the mounting bracket engaging a wall-mounted bracket for installation of the device on a wall.

FIG. 11*c* is a detail of the mounting bracket 33 engaging a wall-mounted bracket 34 for installation of the device on a wall. Once the mounting bracket 33 is secured to the outer housing, the outer housing can then be secured to the wall-mounted bracket 34. This then secures the device to a wall 105. Note that this attachment can be permanent or removable, as desired.

Figure 11D:
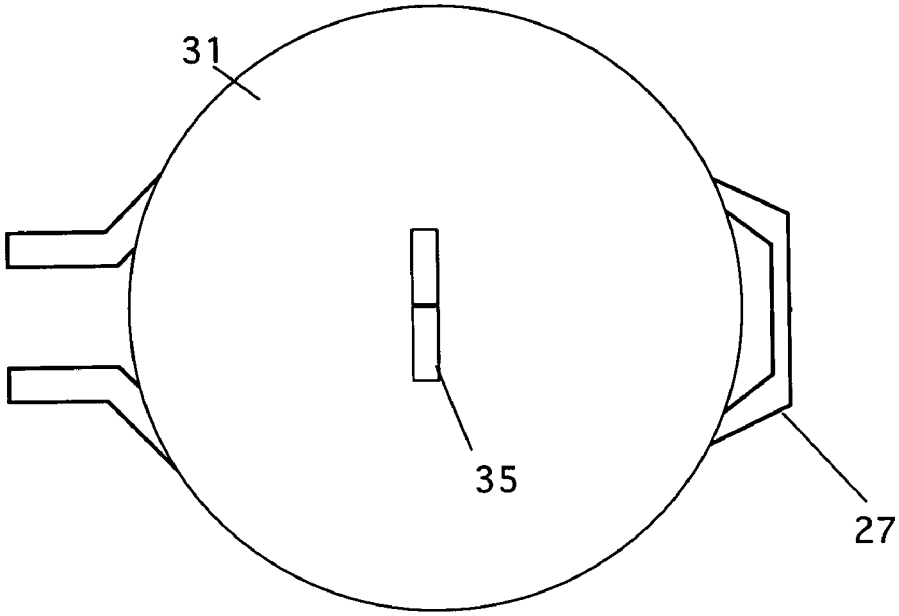
FIG. 11*d* is a detail view of a second mounting bracket secured to the device for engaging a pipe or bar.

FIG. 11*d* is a detail view of a second mounting bracket 35 secured to the disk 31. This bracket is used for securing the device to a pipe or bar.

Figure 11E:
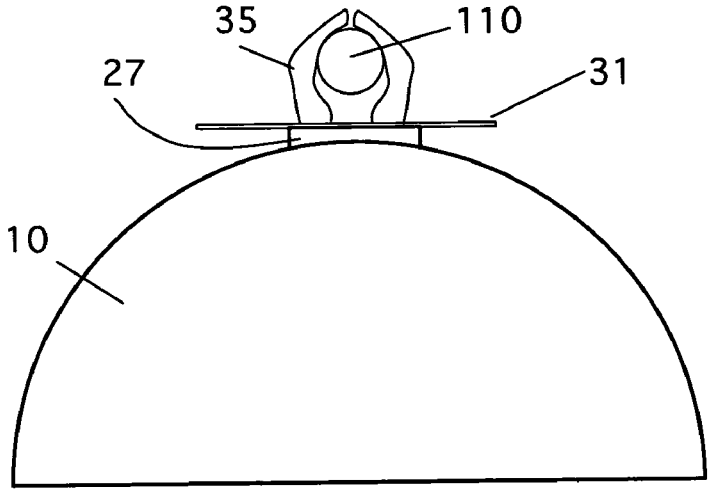
FIG. 11*e* is a side view showing the pipe bracket secured to a bar or pipe.

FIG. 11*e* is a side view showing the pipe bracket 35 secured to a bar or pipe 110. Note here that the bracket can be tightened or held by common fasteners as desired to securely hold the device in place.

Figure 11F:
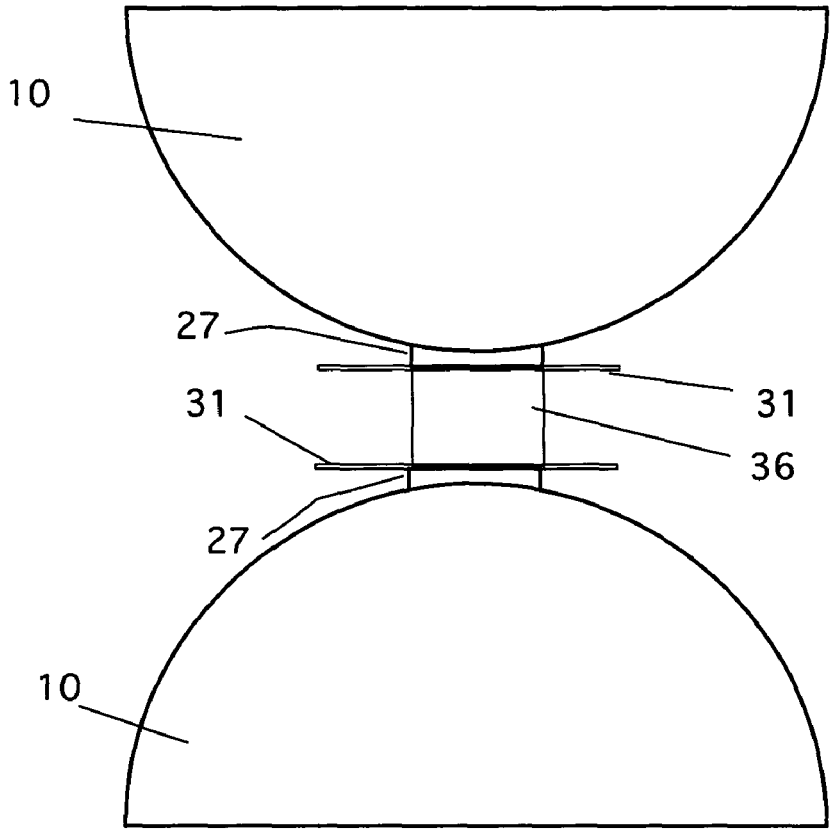
FIG. 11*f* is a detail view of a third mounting bracket allowing two of the devices to be connected allowing a workout for both wrists/arms simultaneously.

FIG. 11*f* is a detail view of a third mounting bracket allowing two of the devices to connected allowing a workout for both wrists/arms simultaneously. In this figure, two outer housings 10 are shown, each having a bracket 27 and a disk 31. Attached to each disk is a connector 36 that attached both units together as shown. When connected, the user grips one pendulum with one hand and the other pendulum with the other hand. In this way, the user can work both wrists simultaneously.

Figure 11G:
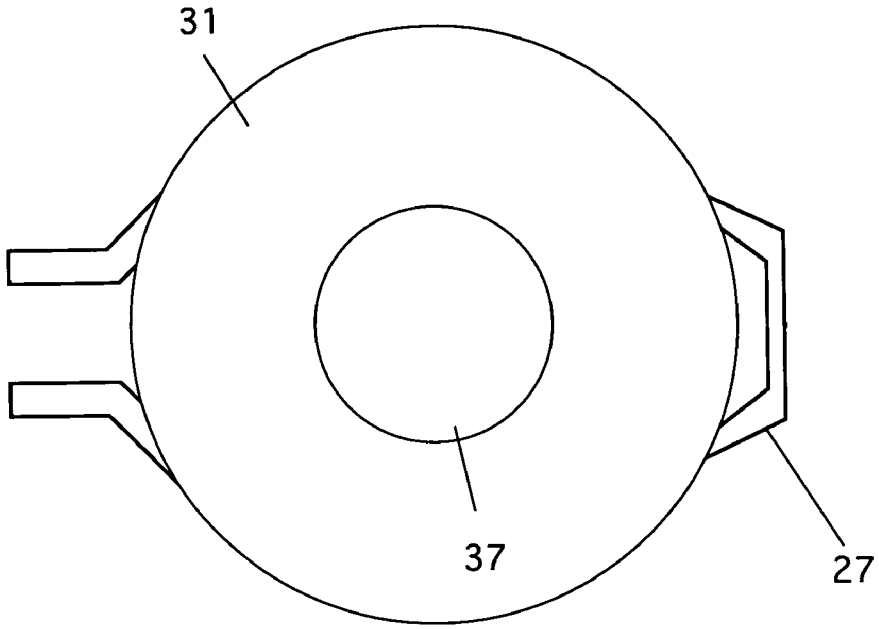
FIG. 11*g* is a detail view of a magnetic mounting bracket to attach the unit to a metal surface.
Figure 11H:
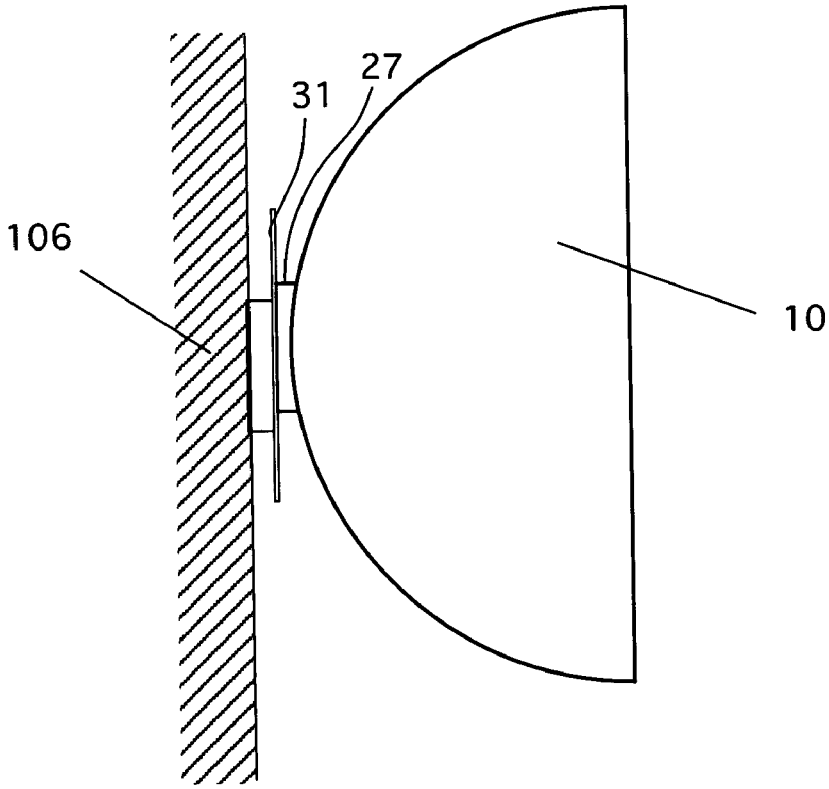
FIG. 11*h* is a side view of the device with a magnetic mounting bracket attached to a metal surface.

FIG. 11*g* is a detail view of a magnetic mounting bracket to attach the unit to a metal surface. Here, a magnet 37 is secured to the disk 31, which in turn, is secured to the bracket 27 as before. FIG. 11*h* is a side view of the outer housing 10 with the magnetic mounting bracket 37 attached to a metal surface 106.

Figure 11I:
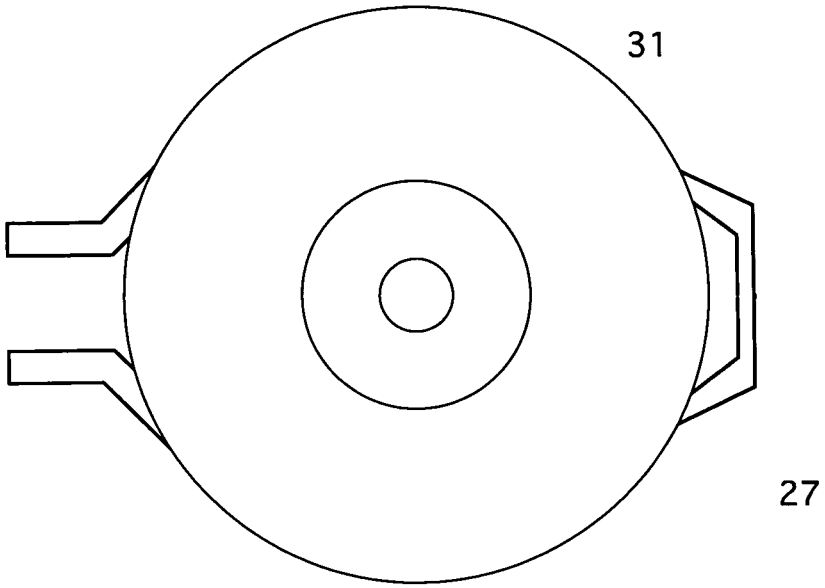
FIG. 11*i* is a detail view of a suction cup to attach the unit to a surface.

FIG. 11*i* is a detail view of a suction cup 38 used to attach the device to a surface. The suction cup 37 is shown attached to the disk 31, which is attached to the bracket 27.

Figure 11J:
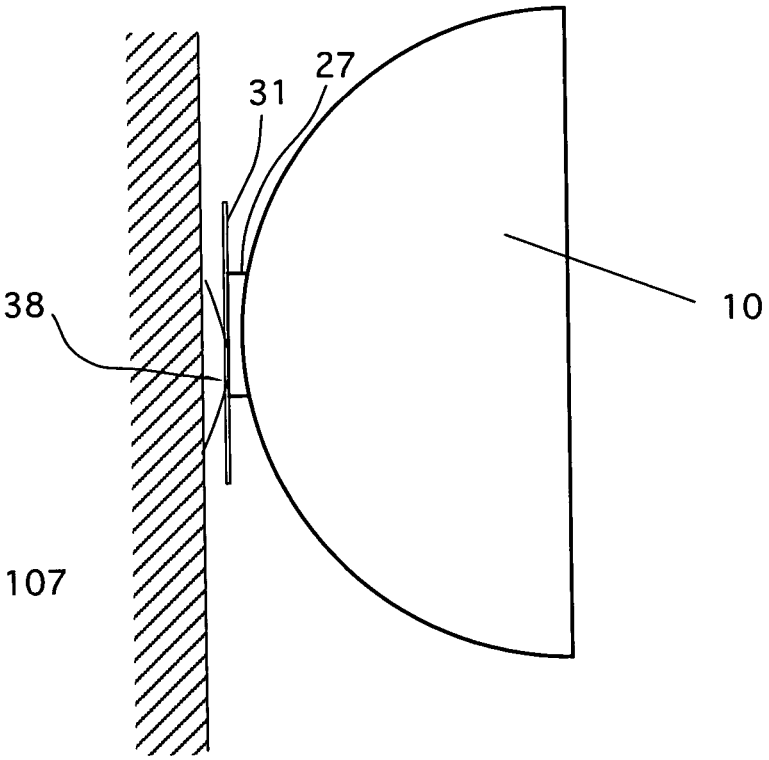
FIG. 11*j* is a side view of the device with the suction cup attached to a surface.

FIG. 11*j* is a side view of the outer housing 10 with the suction cup 38 attached to a surface 107.

Figure 12:
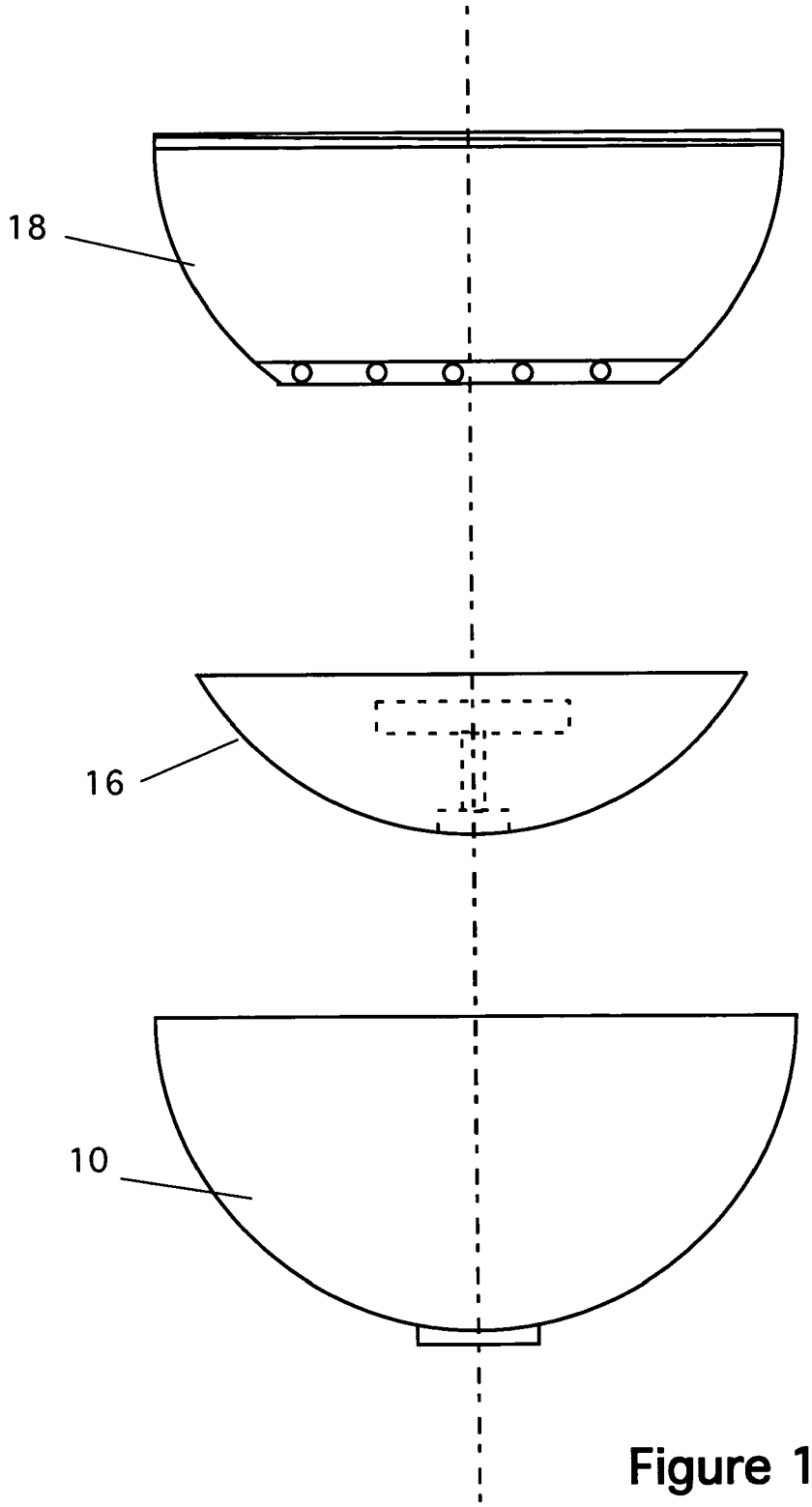
FIG. 12 is an exploded view of the outer housing, pendulum and pressure bowl.

FIG. 12 is an exploded view of the outer housing 10, pendulum 16 and pressure bowl 18. As discussed above, the three components are assembled by stacking the pendulum and pressure bowl within the outer housing.

Figure 13:
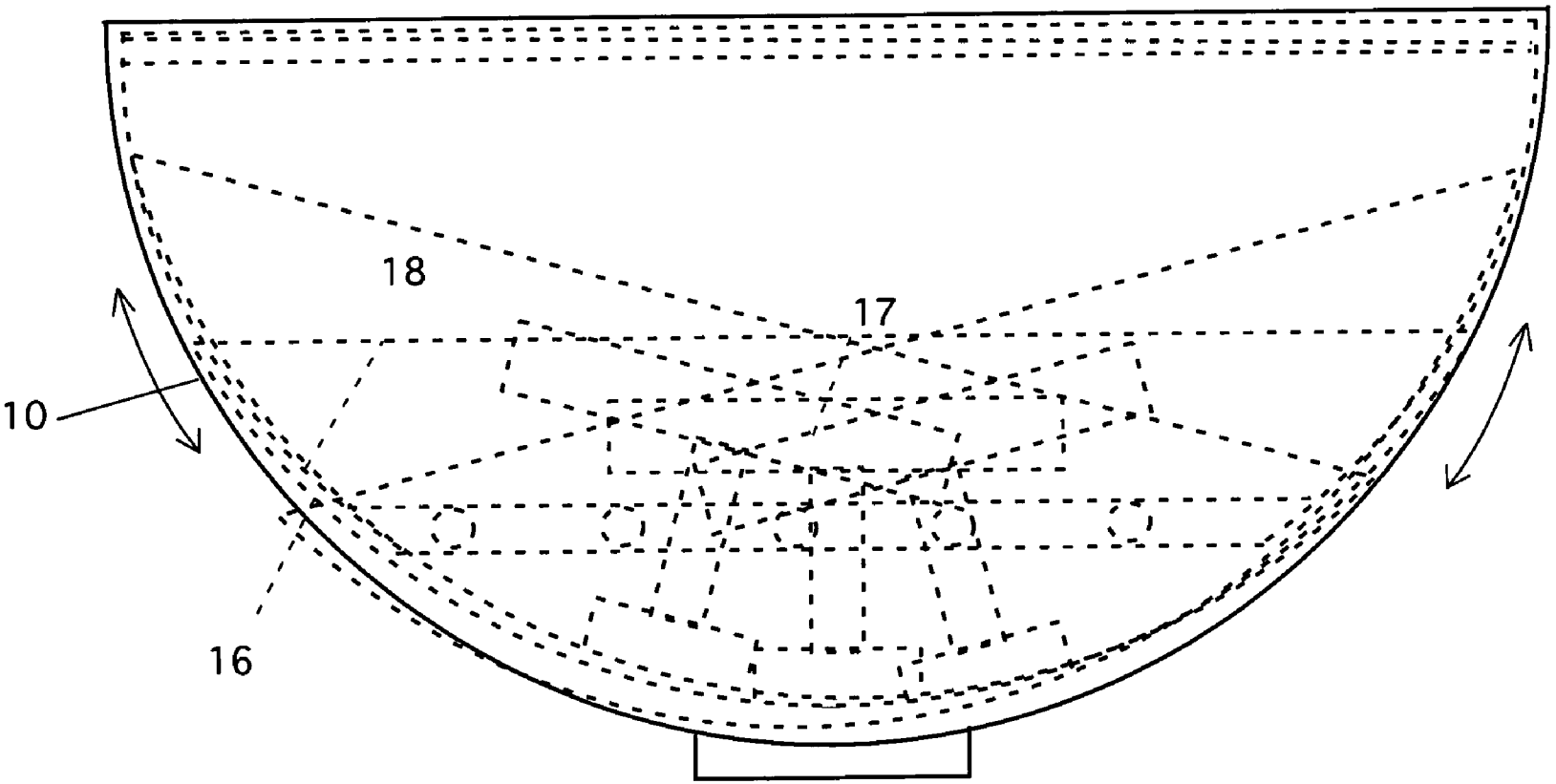
FIG. 13 is a side view of the assembled invention.

FIG. 13 is a side view of the assembled invention. Here, the outer housing 10, pendulum 16 and pressure bowl 18 are shown assembled for use.

To use the device after it is assembled, the user first attaches the desired mounting hardware (glove or wall mount system) to the outer housing. The user then adjusts the pressure bowl to achieve the desired pressure. Finally, the user rotates the pendulum up, down and around within the outer bowl (see the arrows) to work the user's wrist. When one wrist is sufficiently exercised, the user switches hands and repeats the process. As noted, FIG. 11*f* allows the user to use two devices simultaneously, working both wrists while holding both devices.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A device for exercising a user's wrists and arms comprising:

a) an outer housing;

b) a pendulum bowl, having a hollow interior, and an open top having an outer edge on said open top, slidably installed within said outer housing, said pendulum bowl having a handle with a top, attached thereto, said handle being positioned entirely within said hollow interior of said pendulum bowl, such that the top of said handle is positioned below the outer edge of said open top of said pendulum bowl;

c) a pressure bowl, threadably secured within said outer housing such that said pressure bowl controls the effort needed to move the pendulum bowl within the outer housing; and d) a means for restraining the movement of the outer housing during use.

2. The device of claim 1 where the outer housing further comprises a bearing, installed within said outer housing such that said pendulum bowl rests on said bearing.

3. The device of claim 1 wherein said pressure bowl further comprises a bearing, installed on said pressure bowl such that said bearing rests on said pendulum bowl.

4. The device of claim 1 wherein the means for restraining the movement of the outer housing comprise:

a) an attachment clip, secured to said outer housing;

b) a disk, attached to said attachment clip; and c) a gripping accessory, attached to said disk.

5. The device of claim 4 wherein the gripping accessory is selected from the group of: a glove, secured to said disk; a mounting bracket for engaging a wall; a bracket for engaging a pipe; a magnet; and a suction cup.

6. The device of claim 4 wherein the gripping accessory comprises a first bracket, secured to said disk on a first outer housing and a second bracket, secured to a second outer housing such that said first bracket is attached to said second bracket, thereby connecting the first and second outer housings together.

7. A device for exercising a user's wrists and arms comprising:

a) an outer housing;

b) a pendulum bowl, having a hollow interior, and an open top having an outer edge on said open top, slidably installed within said outer housing, said pendulum bowl having a "T"-shaped handle, having a top, attached thereto said "T"-shaped handle being positioned entirely within said hollow interior of said pendulum bowl, such that the top of said "T"-shaped handle is positioned below the outer edge of said open top of said pendulum bowl;

c) a pressure bowl, threadably secured within said outer housing such that said pressure bowl controls the effort needed to move the pendulum bowl within the outer housing; and d) a means for restraining the movement of the outer housing during use.

8. The device of claim 7 where the outer housing further comprises a bearing, installed within said outer housing such that said pendulum bowl rests on said bearing.

9. The device of claim 7 wherein said pressure bowl further comprises a bearing, installed on said pressure bowl such that said bearing rests on said pendulum bowl.

10. The device of claim 7 wherein the means for restraining the movement of the outer housing comprise:

a) an attachment clip, secured to said outer housing;

b) a disk, attached to said attachment clip; and c) a gripping accessory, attached to said disk.

11. The device of claim 10 wherein the gripping accessory is selected from the group of: a glove, secured to said disk; a mounting bracket for engaging a wall; a bracket for engaging a pipe; a magnet; and a suction cup.

12. The device of claim 10 wherein the gripping accessory comprises a first bracket, secured to said disk on a first outer housing and a second bracket, secured to a second outer housing such that said first bracket is attached to said second bracket, thereby connecting the first and second outer housings together.

13. A device for exercising a user's wrists and arms comprising:

a) an outer housing, said outer housing having a curved inner surface and a tapered ring bearing installed on said inner surface;

b) a pendulum bowl, having a hollow interior, and an open top having an outer edge, slidably installed within said outer housing, said pendulum bowl having a "T"-shaped handle attached thereto, thereto, said "T"-shaped handle being positioned entirely within said hollow interior of said pendulum bowl, such that the top of said "T"-shaped handle is positioned below the outer edge of said open top of said pendulum bowl, said pendulum bowl sized to rest upon said tapered ring bearing in said outer housing;

c) a pressure bowl, threadably secured within said outer housing, said pressure bowl also having a tapered ring bearing installed on said pressure bowl such that said tapered ring bearing rests on said pendulum bowl; and d) a means for restraining the movement of the outer housing during use.

14. The device of claim 13 wherein the means for restraining the movement of the outer housing comprise:

a) an attachment clip, secured to said outer housing;

b) a disk, attached to said attachment clip; and c) a gripping accessory, attached to said disk.

15. The device of claim 14 wherein the gripping accessory is selected from the group of: a glove, secured to said disk; a mounting bracket for engaging a wall; a bracket for engaging a pipe; a magnet; and a suction cup.

16. The device of claim 14 wherein the gripping accessory comprises a first bracket, secured to said disk on a first outer housing and a second bracket, secured to a second outer housing such that said first bracket is attached to said second bracket, thereby connecting the first and second outer housings together.

* * * * *